United States Patent [19]

Brickwedde

[11] Patent Number: 4,583,939

[45] Date of Patent: Apr. 22, 1986

[54] COMBINATION CIGARETTE LIGHTER AND PERFUME DISPENSER

[76] Inventor: Richard Brickwedde, 134-25 96th St., Ozone Park, N.Y. 11417

[21] Appl. No.: 666,178

[22] Filed: Oct. 29, 1984

[51] Int. Cl.[4] ..... F23Q 1/02

[52] U.S. Cl. ..... 431/253

[58] Field of Search ..... 431/253; 206/86, 229, 206/536; 131/178; D27/38; D28/77; 222/192, 129, 132

[56] References Cited

U.S. PATENT DOCUMENTS 2,434,825 1/1948 Williams et al. ..... 431/253 X 2,521,630 9/1950 Florman ..... 431/253 X

*Primary Examiner*—Randall L. Green

*Attorney, Agent, or Firm*—Michael I. Kroll

[57] ABSTRACT

A combination cigarette lighter and perfume dispenser is provided and consists of a cigarette lighting mechanism carried by a casing, a reservoir in the casing adapted to hold a supply of perfume and a pump mechanism for dispensing the perfume from the reservoir and including a discharge orifice in the casing to discharge the perfume therefrom.

1 Claim, 10 Drawing Figures

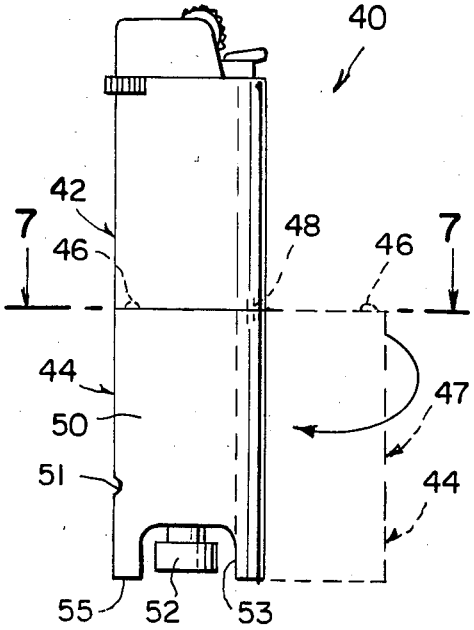
Figure 6
Figure 7
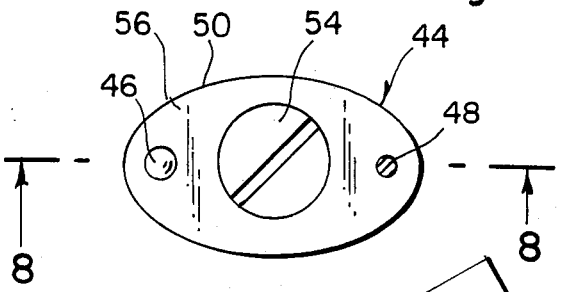
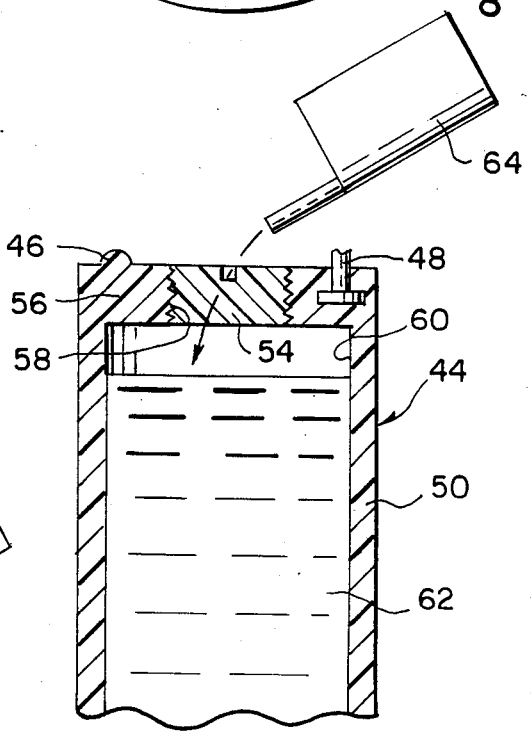
Figure 8
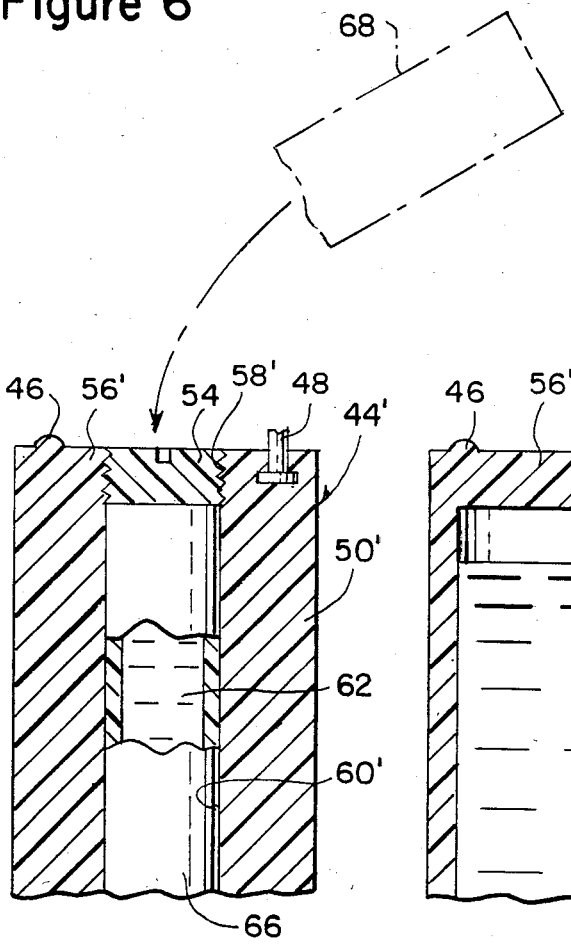
Figure 9
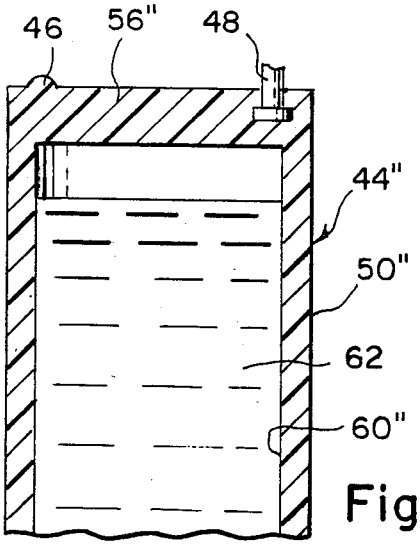
Figure 10

COMBINATION CIGARETTE LIGHTER AND PERFUME DISPENSER

BACKGROUND OF THE INVENTION

1. Field of Invention

The instant invention relates generally to cigarette lighters and more specifically it relates to a combination cigarette lighter and perfume dispenser which can be carried in a woman's handbag or a pants pocket.

2. Description of the Prior Art

Numerous cigarette lighters have been provided in prior art that are adapted to perform other functions. For example U.S. Pat. Nos. 2,434,825 and 2,521,630 are illustrative of such prior art. While these units may be suitable for the particular purpose to which they address, they would not be suitable for the purposes of the present invention as heretofore described.

SUMMARY OF THE INVENTION

A principle object of the present invention is to provide a combination cigarette lighter and perfume dispenser that is compact in size and can be carried easily within a woman's handbag or a pants pocket.

Another object is to provide a combination cigarette lighter and perfume dispenser that is durable and leak proof so that it can be used for a long period of time.

An additional object is to provide a combination cigarette lighter and perfume dispenser that further contains a compartment for holding a supply of pills or the like.

A further object is to provide a combination cigarette lighter and perfume dispenser that is simple and easy to use.

A still further object is to provide a combination cigarette lighter and perfume dispenser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 6 is a front elevational view of a second modification of the invention.

FIG. 7 is an enlarged cross sectional view taken along line 7—7 in FIG. 6 showing the perfume reservoir.

FIG. 8 is a partial cross sectional view taken along line 8—8 in FIG. 7.

FIG. 9 is a partial cross sectional view similar to FIG. 8 showing a second form of the perfume reservoir.

FIG. 10 is a partial cross sectional view similar to FIG. 9 showing a third form of the perfume reservoir.

DETAILED DESCRIPTION OF THE PREFERRED EMBODIMENTS

Figure 1:
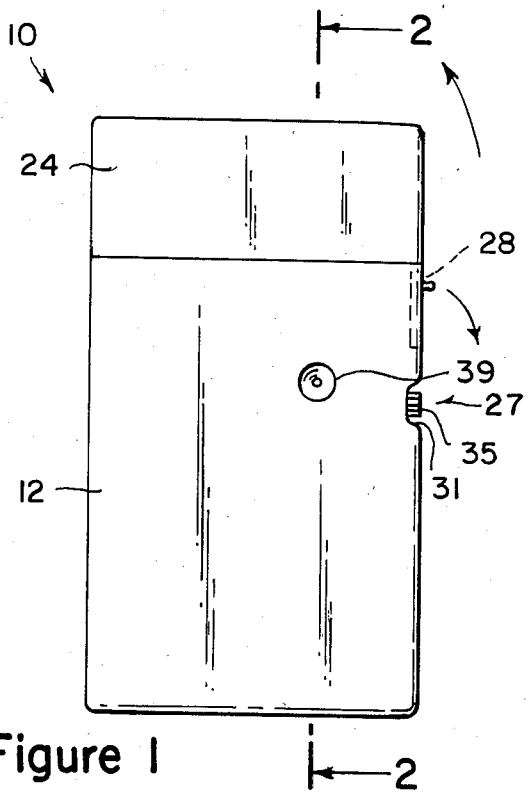
FIG. 1 is a front elevational view of the invention.
Figure 2:
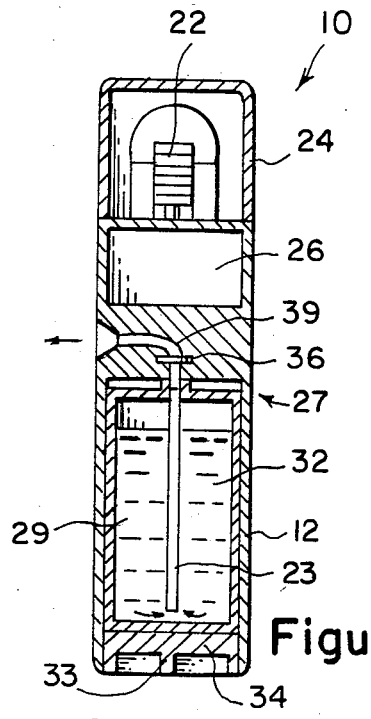
FIG. 2 is a cross sectional view taken along line 2—2 in FIG. 1.
Figure 3:
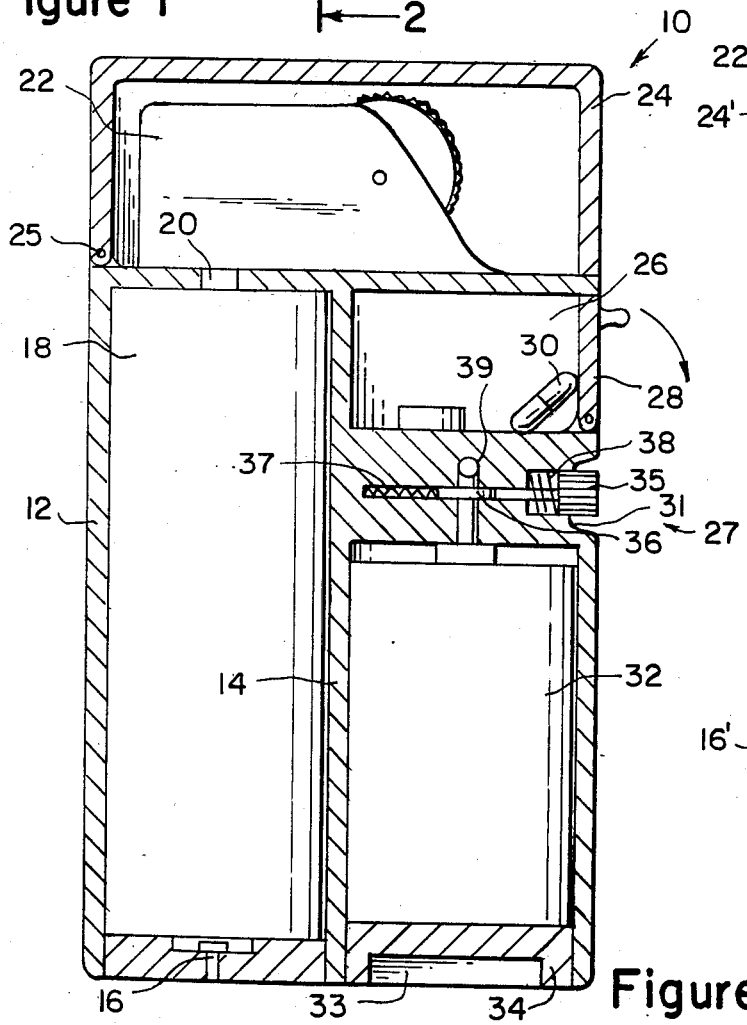
FIG. 3 is an enlarged cross sectional view taken along line 3—3 in FIG. 2.

Turning now descriptively to the drawings, in which similar reference characters denote similar elements throughout the several views, FIGS. 1 through 3 illustrates a combination cigarette lighter and perfume dispenser 10 that consists of a casing 12, a cigarette lighting mechanism 22 for igniting and sustaining an open flame carried by the casing 12, a reservoir 32 in the casing 12 adapted to hold a supply of perfume 29 and pump mechanism 27 for dispensing the perfume 29 from the reservoir 32. The pump mechanism 27 includes a discharge orifice 39 in the casing 12 to discharge the perfume 29 therefrom.

The pump mechanism 27 consists of an elongated pipe 23, a valve 36 and a push button 35. The elongated pipe 23 extends from within the reservoir 32 to the discharge orifice 39. The valve 36 is located on the pipe 23 between the reservoir 32 and the discharge orifice 39. The push button 35 in recess 31 in casing 12 is spring loaded by spring 38 while the valve 36 is also spring loaded by spring 37 so that the push button 35 can manually activate the valve 36 for dispensing the perfume 29.

The invention 10 further contains a compartment 26 in the casing 12 that has a door 28. The compartment 26 is adapted to hold a supply of pills 30 or the like.

As best seen in FIG. 3 the casing 12 has a dividing wall 14 to separate the perfume reservoir 32 from a butane reservoir 18. The butane reservoir 18 has a valve 16 at the bottom of the casing 12 for refilling and a fuel line 20 connected to the cigarette lighting mechanism 22. A flip up lighter cap 24 with hinge 25 is connected to top of the casing 12 to cover the cigarette lighting mechanism 22 for protection when not in use. A cap 34 having a finger grip 33 is also provided so that the perfume reservoir 32 can be replaced when needed.

Figure 4:
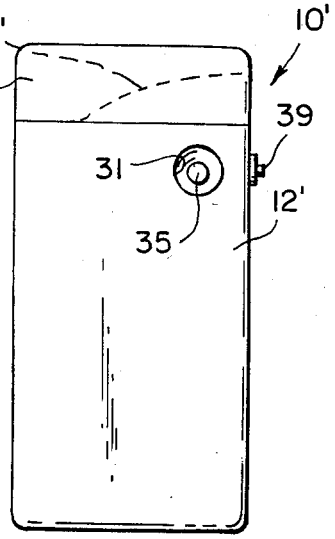
FIG. 4 is a front elevational view of a first modification of the invention.
Figure 5:
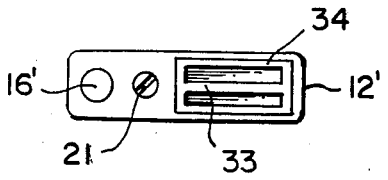
FIG. 5 is a bottom view thereof of FIG. 4.

FIGS. 4 and 5 show a first modification 10 of the invention wherein the cigarette lighting mechanism 22' is either electronic or a flint type and the casing 12' and cap 24' is narrower than the casing 12 and cap 24 in FIG. 1. A valve 16' is also at the bottom of the casing 12 for refilling and a channel 21 is provided to hold the flint. The discharge orifice 39 and the push button 35 are in reversed positions from the ones shown in FIG. 1 but function in the same way.

FIGS. 6 through 8 show a second modification 40 of the invention wherein the cigarette lighter 42 is separate from the perfume dispenser 44. The lighter 42 is piggy backed and pivotally connected off center to the dispenser 44 by a pivot pin 48.

The dispenser 44 consists of a housing 50 that has a spray hole 51 on the side, a detent 46 on end 56 of the housing 50 opposite the pivot pin 48 to hold the dispenser 44 in alignment with the lighter 42 and a recess 53 on free end 55 of the housing 50 to hold a pump head 52 for manually dispensing the perfume 62 from the housing 50 through the spray hole 51.

As best seen in FIG. 8 the housing 50 has a hollow chamber 60 to hold the liquid perfume 62. A removable cap 54 is threaded into hole 58 in end 56 of the housing 50 so that when the dispenser 44 is pivoted to an open position 47, as shown dotted in FIG. 6 the cap 54 can be removed. A liquid perfume refill bottle 64 is now used to refill the hollow chamber 60 with perfume 62.

FIG. 9 shows a second type of perfume dispenser 44'. The housing 50' has a narrow hollow chamber 60' to hold a cartridge 66 having perfume 62 within. The removable cap 54 is threaded into hole 53' in end 56' of the housing 50' whereby the cap 54 can be removed to replace the cartridge 66 with a new cartridge 68 shown in dot-dash lines.

FIG. 10 shows a third type of perfume dispenser 44''. The housing 50'' has a hollow chamber 60'' to hold the perfume 62 within is sealed at end 56'' so that when the perfume 62 is used up the housing 50'' can be disposed of in the usual manner.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination cigarette lighter and perfume dispenser which comprises:

(a) a casing having two hollow chambers and including a discharge orifice in said casing to discharge perfume therefrom;

(b) a cigarette lighting mechanism for igniting and sustaining an open flame carried by said first hollow chamber of said casing;

(c) a reservoir in said second hollow chamber of said casing adapted to hold a supply of perfume;

(d) a pump mechanism which comprising an elongated pipe extending from within said reservoir to said discharge orifice, a valve located on said pipe between said reservoir and said discharge orifice, and a spring loaded push button to manually activate said valve for dispensing said perfume; and (d) a compartment having a hollow cavity and a door, said cavity is adapted to hold a supply of pills or the like and is located adjacent said reservoir while said door can be opened to gain access to said cavity.

* * * * *